United States Patent [19]

Kim

[11] 3,964,121

[45]* June 22, 1976

[54] MOP HOLDER AND BRUSH COMBINATION

[76] Inventor: Kwan Chi Kim, 133 Mauna Kea St., Hilo, Hawaii 96720

[ * ] Notice: The portion of the term of this patent subsequent to June 22, 1991, has been disclaimed.

[22] Filed: Jan. 18, 1971

[21] Appl. No.: 107,291

[52] U.S. Cl. ..... 15/115; 15/144 R

[51] Int. Cl.[2] ..... A47L 13/12

[58] Field of Search ..... 15/51, 52, 106, 114, 15/115, 116 R, 116 A, 117, 146, 148; 401/24, 27

[56] References Cited

UNITED STATES PATENTS

| | | | |
|---|---|---|---|
| 206,212 | 7/1878 | Balch | 15/117 |
| 444,043 | 1/1891 | Brosseau | 15/116 R |
| 729,338 | 5/1903 | Hawkins | 15/146 X |
| 732,743 | 7/1903 | Held | 15/115 |
| 732,744 | 7/1903 | Held | 15/115 |
| 1,320,464 | 11/1919 | Glowack | 15/51 |
| 2,133,148 | 10/1938 | Paul | 15/115 |

FOREIGN PATENTS OR APPLICATIONS

| | | | |
|---|---|---|---|
| 186,812 | 9/1956 | Austria | 15/148 |
| 631,734 | 6/1936 | Germany | 15/146 |
| 185,941 | 9/1922 | United Kingdom | 15/116 R |

*Primary Examiner*—Daniel Blum
*Attorney, Agent, or Firm*—William B. Walter

[57] ABSTRACT

A floor mop which is provided with a ready removable brush means so that a floor surface can be quickly and thoroughly cleaned. A standard form of mop is provided with a brush that can be easily removed and quickly attached thereto and whenever the brush is worn and needed to be replaced the operation is very simple and as simple as replacing a mop to its holder. The brush is so arranged and equipped that it can be attached to a standard type of mop device which is obtainable in the market place.

3 Claims, 5 Drawing Figures

INVENTOR
KWAN C. KIM

BY

Earl E. Moore
ATTORNEY

MOP HOLDER AND BRUSH COMBINATION

BACKGROUND OF THE INVENTION

The general utility of a rag or string mop combined with scrubbing units on the mop head has been demonstrated by a variety of patents for over 80 years. Among the inventions have been relatively light-duty attachments either requiring modification of the mop holders as in Neumann patent, U.S. Pat. No. 2,683,886 and McLaughlin, Ser. No. 937,007; or disengagement of the mop clamping means at installation and removal of the scrubbing unit, or a part thereof, as in Held, Ser. Nos. 732,743 and 732,744; Wilson, Ser. No. 701,657; Dryden, U.S. Pat. No. 3,167,798; and Paul, U.S. Pat. No. 2,133,148. Such combination mop and scrubbing units have undoubtedly been of value in increasing the efficiency of the person cleaning floors and decks. However, due to the nature of the work and the need to exert much effort in scrubbing dirty areas, there is a need for a rugged heavy duty quick connect and disconnect scrubbing unit for mop holders. The ease of removal and subsequent installation of such a unit is also an important factor in allowing quick replacement of worn-out or gummed up units.

BRIEF SUMMARY OF THE INVENTION

My invention is a rugged heavy duty quick connect and disconnect brush for open frame mop holders featuring a base member carrying the quick connect means which firmly secures the base member to the frame for its length (without use of the mop clamp) and thus the the brush to the frame by a resilient attachment of brush to base allowing the brush when in use to remain flat to the surface to be cleaned varying the pressure on the toe and heel of the brush as desired.

An object of the invention is to provide ready obtainable mops with a brush which is easily and quickly attached to mop holders and also easily and quickly removable therefrom.

Another object is to provide a brush device that is adapted to be attached to common mop holders and which brush device is economical to make and manufacture.

IN THE DRAWINGS

DETAILED DESCRIPTION OF THE INVENTION

Figure 1:
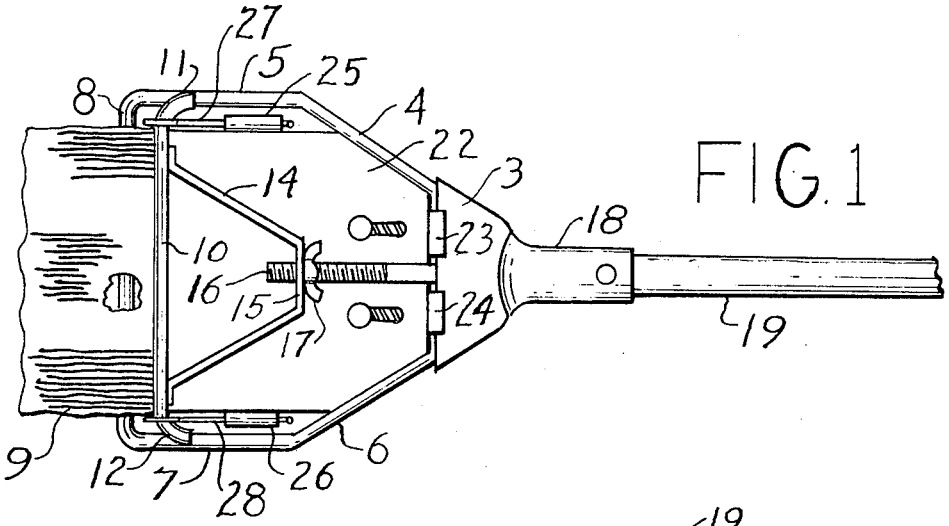
FIG. 1 is a top plan view of a mop device and a brush device attached thereto with certain parts thereof broken away.

As illustrated, a standard form of mop holder 1 is indicated and a brush unit or scrubbing device 2 is shown attached thereto. The mop holder has a heavy wire frame consisting of the head portion 3 from which the diagonal portions 4 and 6 extend to the longitudinal portions 5 and 7 the ends of which are joined by the transverse portion 8 over which a mop 9 is draped in the manner shown.

In order to hold the mop 9 in its proper place, a slide bar 10 with C-shaped cross-section is provided and which bar has turned ends 11 and 12. The C-shaped cross-section of these ends comprise a groove means 13 which are adapted to ride along the portions 5 and 7. A V-like frame means 14 has its legs fixed to the slide bar 10 and a flat portion 15 has a bore to accommodate the screw member 16 and the upper end of which is fixed to the head 3. The screw member 16 is provided with a winged nut means 17 so that the bar 10 can be squeezed against the the mop to hold it or allow the mop to be removed when the bar is released.

The lower portion of the head 3 is flat whereas the upper end thereof has the integral portion 18 which is tubular and sized to receive the lower end of a handle or stick means 19 in the well known manner. This constitutes the general form of a mop holder.

Figure 4:
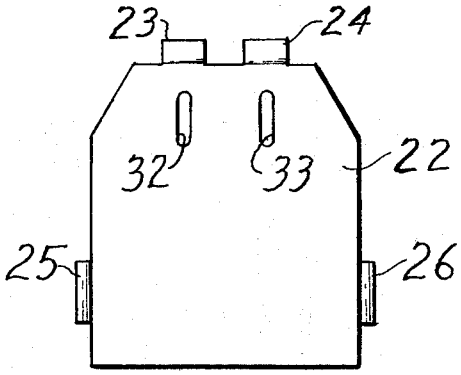
FIG. 4 is a top plan view of the generally flat base member per se without attachments thereto.

The brush means 2 has the head portion 20 which is rectangular in plan and which holds the brushing bristles or fibers 21 in a well known manner. A generally flat base member 22 with its upper corners biased has the offset integral hooks 23 and 24 which are adapted to engage the head 3 in the manner best shown in FIG. 2 of the drawings. The side edges of this base have the tubular guides 25 and 26 which are welded to the base and positioned as clearly shown in FIG. 4.

Figure 5:
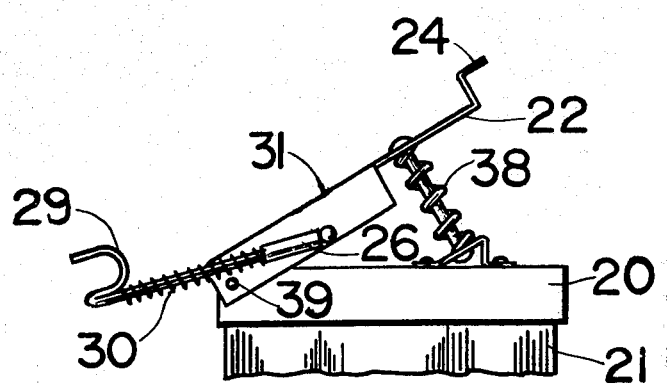
FIG. 5 is a side view of the quick connect scrubbing means as a separate unit not attached to the mop holder.

These guides accommodate the hook means 27 and 28 and the shanks of which slide in their respective guides. Each hook has a stop means at its top end and the other end of each hook is formed as shown at 29 in FIG. 5. These hook ends 29 engage the slide bar 10 and a coiled spring means 30 of each hook constantly urges the hook end 29 against the bar 10. A downwardly formed flange 31 on each side of the base 22 provides the support for the guides 25 and 26.

The base 22 has the pair of spaced apart slots 32 and 33 which accommodate the upper ends of the stems 34 and 35 respectively. This arrangement allows the top of the stems to slide in the slots as the plate is approached by the brush head 20. The bottom ends of the stem are supported by the bracket means 36 and 37 and which brackets are fixed to the brush head by screws or other suitable means. Each stem is provided with a compression spring 38 which urges the base and brush head apart. The forward end of the brush head is attached to the flanges 31 of the plate by the pivot means indicated at 39, each side having such a pivot means so that when pressure is exerted downwardly on the brush head the springs 38 will contract.

MODE OF OPERATION OF THE INVENTION

To remove the brush from the mop holder, it is only necessary to force the base toward the mop 9 to compress springs 30 thus retracting hooks 27 and 28 to free the hooks 23 and 24 from the head 3 and the reverse operation would obviously attach the base 22 to the mop holder.

Figure 2:
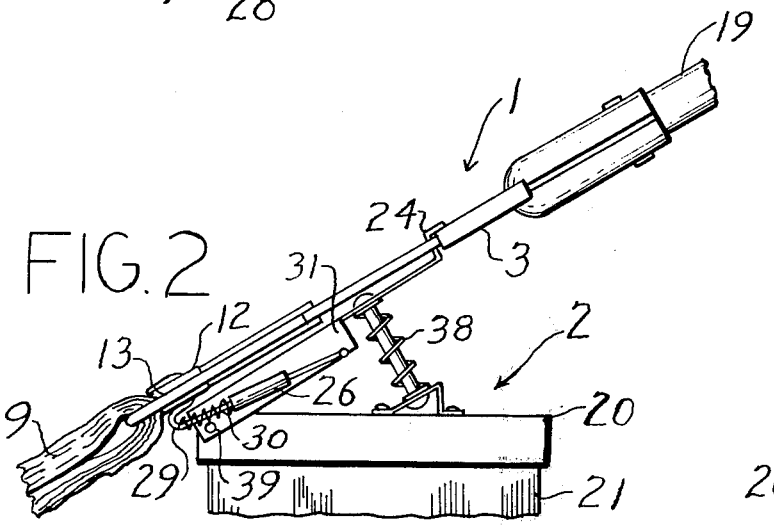
FIG. 2 is a side elevational view of that shown in FIG. 1 with parts broken away.
Figure 3:
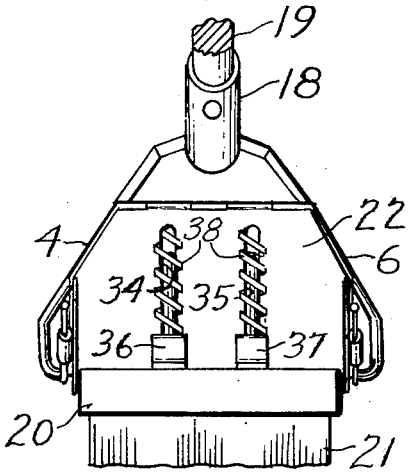
FIG. 3 is a rear elevational view of that shown in FIG. 2.

In use as a combination mop and brush unit when the quick connect brush according to my invention has been attached to the mop holder 1 with mop installed, the user can first mop the floor with the brush on top so as to not interfere with the mopping operation. Where the scrubbing action is required the mop holder is turned over as in FIG. 2 and pressure can be applied to both the toe and the heel of the brush 2 because of the action of springs 38 and pivot 39. As the brush is pushed to the left as shown in FIG. 2 force is exerted to it from the handle 19 through hooks 23 and 24. When pulled to the right the force is exerted from the handle 19 through bar 10 to S-shaped hooks 27 and 28 and compression springs 30 to base 22. Springs 30 are strong enough to resist this force without releasing hooks 23 and 24 and yet not so strong as to unduly resist attaching and detaching the two units.

Certain novel features and details of this invention are disclosed in detail in order to make the invention clear in at least one form thereof. However, it is to be clearly understood that the invention as disclosed is not necessarily limited to the exact form and details as disclosed since it is apparent that various modifications and changes may be made without departing from the spirit of the invention.

Having thus described my invention, what is claimed and believed new and which is desired to be secured by Letter Patent is:

1. A combination mop holder and brushing means comprising:

a. a mop holder of the open frame type with a handle attached to one end of the open frame and a mop attached to the other end of the open frame; and b. a brushing means comprising:

1. a generally flat brush;
2. a generally flat base member;
3. a resilient biasing means operably connecting the base member and the brush; and
4. quick connect means fixed to the base member operably connecting the base member to the mop holder comprising two sets of hooking means, one set of which engages the handle end of the open frame, and the other set of which engages the mop end of the open frame, said quick connect means also comprises a spring means which constantly urges the latter set of hooking means towards and against the mop end of the frame.

2. A combination mop holder and brushing means comprising:

a. a mop holder of the open frame type with a handle attached to one end of the open frame and a mop attached to the other end of the open frame; and b. a brushing means comprising:

1. a generally flat brush;
2. a generally flat base member;
3. a resilient biasing means comprising a pivotal attaching means operably connecting the base member and brush and a spring connection means also operably connecting the base member and brush acting to open the angle between the base member and brush, and
4. quick connect means fixed to the base member operably connecting the base member to the mop holder comprising two sets of hooking means, one set of which engages the mop end of the open frame and the other set of which hooking means engages the handle end of the open frame.

3. A combination mop holder and brushing means comprising:

a. a mop holder of the open frame type with a handle attached to one end of the open frame and a mop attached to the other end of the open frame; and b. a brushing means comprising:

1. a generally flat brush;
2. a generally flat base member;
3. a resilient biasing means comprising a pivotal attaching means operably connecting the base member and brush at the mop end of the base member and the brush and a spring connection means also operably connecting the base member and the brush and acting to open the angle between the base member and brush, and
4. quick connect means fixed to the base member operably connecting the base member to the mop holder comprising two sets of hooking means, one set of which engages the mop end of the open frame and the other set of which hooking means engages the handle end of the open frame.

* * * * *